US008899208B2

(12) United States Patent
Bischofberger

(10) Patent No.: US 8,899,208 B2
(45) Date of Patent: Dec. 2, 2014

(54) INTERNAL COMBUSTION ENGINE PISTON HAVING AXIALLY EXTENDING COOLING BORES

(75) Inventor: Ulrich Bischofberger, Esslingen (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 13/995,017

(22) PCT Filed: Dec. 15, 2011

(86) PCT No.: PCT/DE2011/002128

§ 371 (c)(1),
(2), (4) Date: Aug. 12, 2013

(87) PCT Pub. No.: WO2012/079566

PCT Pub. Date: Jun. 21, 2012

(65) Prior Publication Data

US 2013/0312695 A1 Nov. 28, 2013

(30) Foreign Application Priority Data

Dec. 18, 2010 (DE) ..... 10 2010 055 161
Sep. 22, 2011 (DE) ..... 10 2011 114 105

(51) Int. Cl.
*F02F 3/18* (2006.01)
*F02F 3/22* (2006.01)
*F01P 1/04* (2006.01)

(52) U.S. Cl.
CPC ... *F02F 3/18* (2013.01); *F02F 3/22* (2013.01); *F01P 1/04* (2013.01)
USPC ..... 123/193.6; 123/41.35; 92/186

(58) Field of Classification Search
CPC ..... F02F 3/18; F02F 3/22; F01P 1/04
USPC ..... 123/193.6, 41.35, 41.42; 92/172, 174, 92/186
See application file for complete search history.

(56) References Cited

U.S. PATENT DOCUMENTS 1,763,625 A * 6/1930 Mellor ..... 123/41.38
1,841,796 A 1/1932 Edwards
1,878,566 A 9/1932 Woolson
(Continued)

FOREIGN PATENT DOCUMENTS

AT 118016 B 6/1930
DE 762 820 C 11/1952
(Continued)

OTHER PUBLICATIONS

International Search Report of PCT/DE2011/002128, Aug. 9, 2012.
(Continued)

*Primary Examiner* — Noah Kamen
*Assistant Examiner* — Grant Moubry
(74) *Attorney, Agent, or Firm* — Collard & Roe, P.C.

(57) ABSTRACT

The present invention relates to a piston (10) for an internal combustion engine, comprising a piston head (11) and a piston skirt (16), wherein the piston head (11) has a circumferential ring part (15) and a circumferential cooling channel (23) in the region of the ring part (15), wherein the piston skirt (16) has piston bosses (17), which are provided with boss bores (18) and which are arranged on the underside (11*a*) of the piston head (11) by means of boss connections (19), wherein the piston bosses (17) are connected to each other by means of running surfaces (21, 22). According to the invention, at least one axial bore (24*a*, 24*b*, 24*c*, 24*d*), which is closed to the outside and which is arranged between a running surface (21, 22) and a boss bore (18), is provided inside a piston boss (17), the at least one bore (24*a*, 24*b*, 24*c*, 24*d*) opens into the cooling channel (23), and the cooling channel (23) and the at least one bore (24*a*, 24*b*, 24*c*, 24*d*) contain a filling (27) of sodium and/or potassium.

7 Claims, 2 Drawing Sheets

(56) References Cited

U.S. PATENT DOCUMENTS

Figure 1:
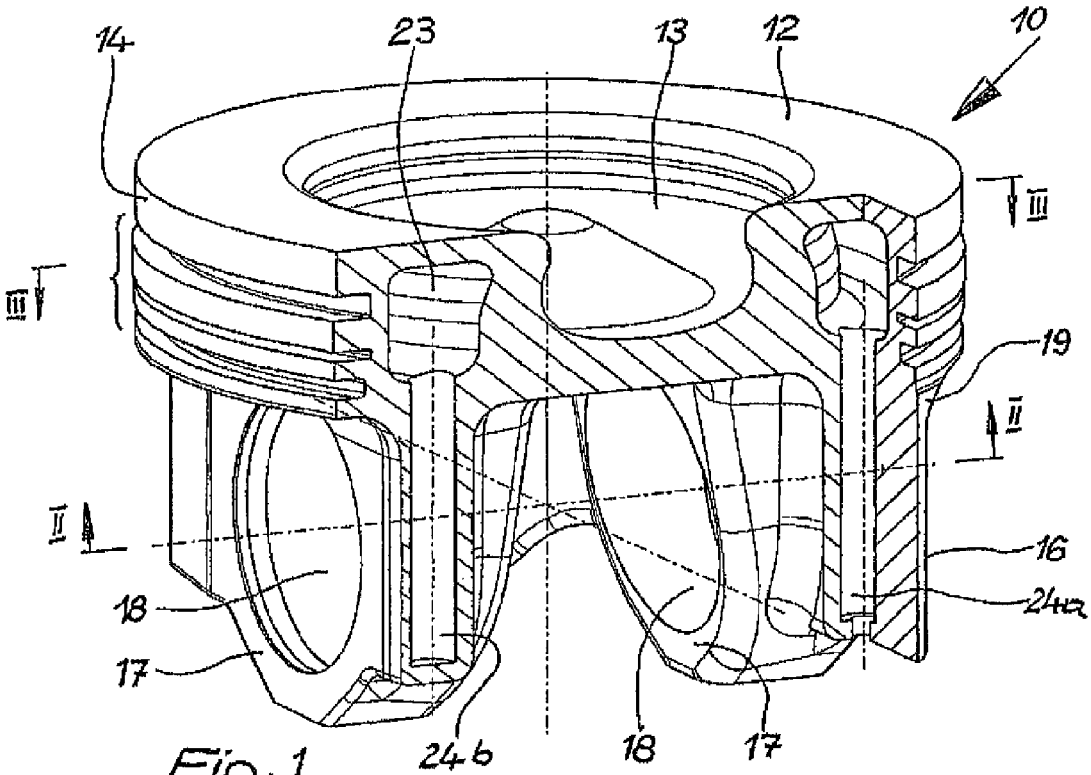

| | | | | | |
|---|---|---|---|---|---|
| 1,953,109 | A * | 4/1934 | Heron | 123/41.16 |
| 2,759,461 | A * | 8/1956 | Maybach et al. | 123/41.35 |
| 2,902,987 | A * | 9/1959 | Schweitzer et al. | 123/41.16 |
| 3,215,130 | A * | 11/1965 | Maier | 123/41.35 |
| 3,613,521 | A * | 10/1971 | Itano | 92/186 |
| 3,703,126 | A * | 11/1972 | Haug | 92/186 |
| 4,083,292 | A * | 4/1978 | Goloff | 92/176 |
| 4,180,027 | A * | 12/1979 | Taylor | 123/41.35 |
| 4,253,429 | A * | 3/1981 | Galli | 123/41.35 |
| 4,513,697 | A * | 4/1985 | Moiroux | 123/41.35 |
| 4,907,545 | A * | 3/1990 | Mills | 123/41.35 |
| 6,032,619 | A * | 3/2000 | Zhu et al. | 123/41.35 |
| 6,904,876 | B1 * | 6/2005 | Hofbauer et al. | 123/46 R |
| 7,628,134 | B2 * | 12/2009 | Scharp | 123/193.6 |
| 7,735,462 | B2 * | 6/2010 | Obermeier | 123/41.35 |
| 7,921,555 | B2 * | 4/2011 | Benz et al. | 29/888.04 |
| 8,511,261 | B2 * | 8/2013 | Maruyama et al. | 123/41.35 |
| 2005/0087153 | A1 | 4/2005 | Moon | |

FOREIGN PATENT DOCUMENTS

| | | | | | |
|---|---|---|---|---|---|
| DE | 26 13 059 | A1 | 6/1977 | | |
| EP | 0 086 284 | A1 | 8/1983 | | |
| FR | 647 110 | A | 11/1928 | | |
| FR | 880 033 | A | 3/1943 | | |
| FR | 2 333 962 | A1 | 7/1977 | | |
| FR | 2 901 577 | A3 | 11/2007 | | |
| GB | 310334 | A | * | 4/1930 | F02F 3/18 |
| GB | 396249 | A | 8/1933 | | |
| GB | 492383 | A | 9/1938 | | |
| IT | 1 057 365 | B | 3/1982 | | |
| JP | 57183540 | A | * | 11/1982 | F02F 3/22 |
| JP | 62-96762 | A | 5/1987 | | |
| JP | 4-265451 | A | 9/1992 | | |
| JP | 2005-127300 | A | 5/2005 | | |
| JP | 2006-299979 | A | 11/2006 | | |
| JP | 2011-153602 | A | 8/2011 | | |

OTHER PUBLICATIONS

German Search Report in German Application No. 10 2010 055 161.9, Aug. 16, 2011.

German Search Report in German Application No. 10 2011 114 105.0, Aug. 6, 2012.

* cited by examiner

INTERNAL COMBUSTION ENGINE PISTON HAVING AXIALLY EXTENDING COOLING BORES

CROSS REFERENCE TO RELATED APPLICATIONS

This application is the National Stage of PCT/DE2011/002128 filed on Dec. 15, 2011, which claims priority under 35 U.S.C. §119 of German Application No. 10 2010 055 161.9 filed on Dec. 18, 2010 and under 35 U.S.C. §119 of German Application No. 10 2011 114 105.0 filed on Sep. 22, 2011, the disclosures of which are incorporated by reference. The international application under PCT article 21(2) was not published in English.

The present invention relates to a piston for an internal combustion engine, having a piston head and a piston skirt, wherein the piston head has a circumferential ring belt, and, in the region of the ring belt, a circumferential cooling channel, wherein the piston skirt has pin bosses provided with pin bores, which are disposed on the underside of the piston head by way of pin boss connections, wherein the pin bosses are connected with one another by way of working surfaces.

In modern internal combustion engines, the pistons are exposed to higher and higher temperature stresses in the region of the piston crowns. This leads to significant temperature differences between the piston head and the piston skirt during operation. Therefore the installation play of the pistons in the cold engine is also different from the installation play in the warm engine.

The task of the present invention consists in further developing a piston of the stated type in such a manner that a more uniform temperature distribution between the piston head and the piston skirt occurs during operation.

The solution consists in that at least one axial bore, closed toward the outside, is provided within a pin boss, which bore is disposed between a working surface and a pin bore, that the at least one bore opens into the cooling channel, and that the cooling channel and the at least one bore contain a filling composed of sodium and/or calcium.

The piston according to the invention is characterized in that the heat produced in the region of the piston crown is passed into the pin bosses, by way of the piston crown, and given off by way of the working surfaces, which have a relatively large surface area. In this way, a uniform temperature distribution is achieved over the entire piston during operation. Furthermore, more effective cooling of the entire piston is achieved.

If, in addition, the underside of the piston head is cooled with cooling oil, the formation of oil carbon is avoided. In total, the cooling oil consumption is furthermore reduced.

Because the difference in the installation play of the piston between the cold and the warm engine is reduced, a lesser play than before can already be adjusted during installation of the piston. Furthermore, friction losses during operation are reduced, in that the working surfaces of the piston are heated in the engine while it is still cold.

Advantageous further developments are evident from the dependent claims.

Preferably, four bores are provided, which are disposed between a working surface and a pin bore, in order to achieve a particularly uniform temperature distribution in the piston.

It is practical if the at least one bore is closed off by means of a closure element, which is pressed into the bore, for example, or welded to the piston, in order to prevent coolant from exiting.

Filling with the coolant preferably demonstrates a filling level up to half the height of the cooling channel, in order to achieve a shaker effect and thereby particularly effective cooling.

Particularly if the proportion of the combustion heat that flows into the piston during engine operation is supposed to be limited, this can be controlled with the amount of coolant filled in. It has been shown that sometimes, filling of 3-5% of the cooling channel volume with the coolant is already sufficient to ensure proper functioning of the piston.

The filling can consist of potassium, sodium, or an alloy of the two metals. A filling composed of a potassium/sodium alloy with 22 wt.-% sodium and 78 wt.-% potassium is particularly practical, because this alloy has a particularly low melting point.

The filling can also additionally contain lithium and/or lithium nitride. If nitrogen is used as a protective gas during filling, this can react with the lithium to form lithium nitride, and can be removed from the cooling channel in this manner.

The filling can furthermore contain sodium oxides and/or potassium oxides, if dry air that might be present has reacted with the coolant during filling.

The piston according to the invention can consist of an iron-based material, for example a material from the group comprising precipitation-hardened steels, annealed steels, high-strength cast iron, and cast iron with lamellar graphite.

Figure 2:
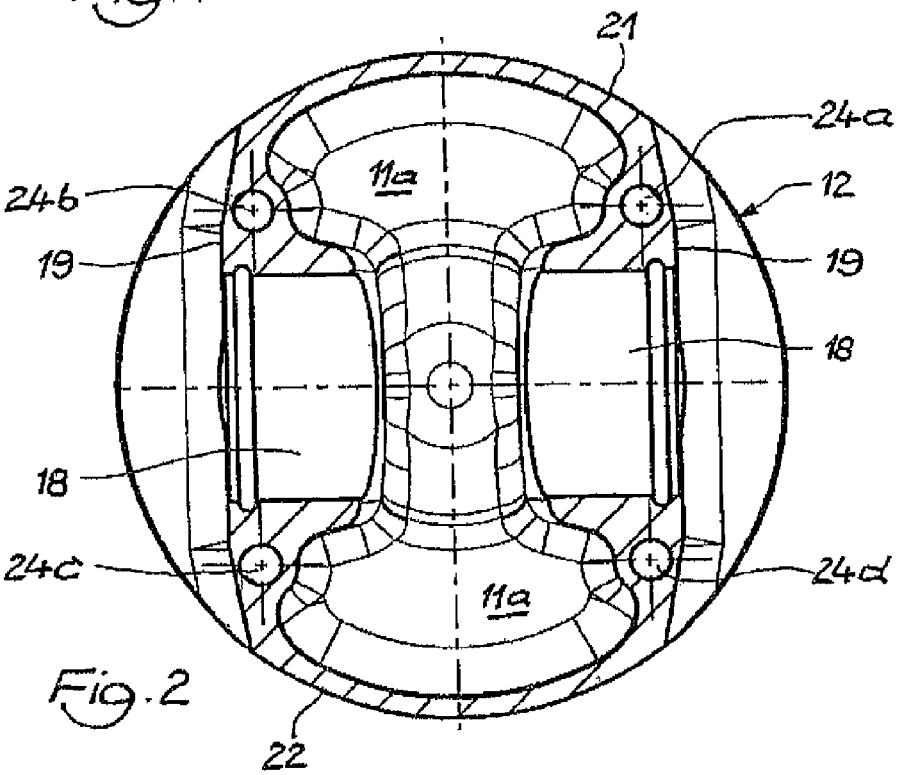
Figure 3:
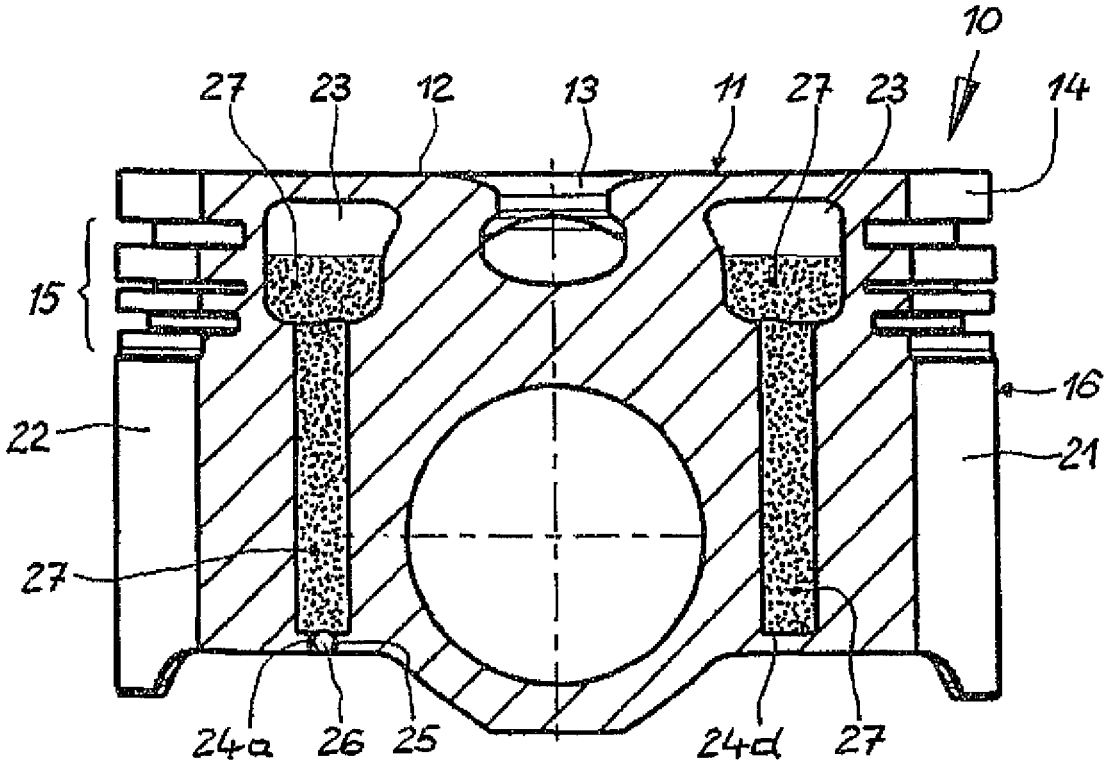
Figure 4:
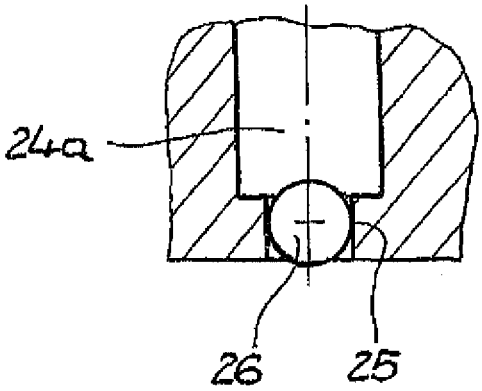

An exemplary embodiment of the present invention will be explained in greater detail below, using the attached drawings. These show, in a schematic representation, not true to scale:

FIG. 1 an exemplary embodiment of a piston according to the invention, partly in section;

FIG. 2 a section along the line II-II in FIG. 1;

FIG. 3 a section along the line III-III in FIG. 1;

FIG. 4 an enlarged partial representation from FIG. 3.

FIGS. 1 to 4 show an exemplary embodiment of a piston 10 according to the invention. The piston 10 can be a single-part or multi-part piston. The piston 10 can be produced from a steel material and/or a light metal material. FIGS. 1 to 3 show a single-part box piston 10 as an example. The piston 10 has a piston head 11 with a piston crown 12 having a combustion bowl 13, a circumferential top land 14, and a ring belt 15 for accommodation of piston rings (not shown). At the level of the ring belt 15, a circumferential cooling channel 23 is provided. The piston 10 furthermore has a piston skirt 16 with pin bosses 17 and pin bores 18 for accommodation of a piston pin (not shown). The pin bosses 17 are connected with the underside 11*a* of the piston head by way of pin boss connections 19. The pin bosses 17 are connected with one another by way of working surface 21, 22 (see, in particular, FIG. 2).

In the exemplary embodiment, the piston skirt 16 has four axial bores 24*a*, 24*b*, 24*c*, 24*d*. The bores 24*a-d* are introduced into the pin bosses, in each instance, and disposed between a working surface 21, 22 and the pin bore 18. The bores 24*a-d* open into the cooling channel 23. In the exemplary embodiment, the piston 10 can be cast, for example, in known manner, whereby the cooling channel 23 and the bores 24*a-d* can be introduced by means of a salt core, in known manner. The important thing is that at least one bore 24*a* has an opening 25 toward the outside. According to the invention, the coolant 27, namely sodium, potassium, or an alloy of the two metals, is filled into the bore 24*a* through the opening 25. From there, the coolant 27 is distributed in the cooling channel 23 and in the further bores 24*b-d*. The opening 25 is subsequently tightly sealed, in the exemplary embodiment by means of a steel ball 26 that is pressed in. The opening 25 can also be closed off, for example, by means of welding on a lid or pressing in a cap (not shown).

The size of the bores 24*a-d* and the filling amount of the coolant 27 are based on the size and the material of the piston 10. On average, about 10 g to 40 g coolant 27 are needed per piston 10. The cooling power can be controlled by way of the amount of the coolant 27 that is added. It is practical if a filling level occurs in the cooling channel 23 that corresponds to approximately half the height of the cooling channel 23. In this case, the known shaker effect can be additionally utilized in operation for effective cooling. For sodium as the coolant 27, with a temperature during operation of 220° C., a maximal surface temperature of the piston 10 of about 260° C. occurs at a cooling power of 350 $kW/m^2$. In addition, the underside 11*a* of the piston head 11 can be cooled by being sprayed with cooling oil.

To fill the bore 24*a*, a lance is introduced through the opening 25, and flushing by means of nitrogen or by means of another suitable inert gas or by means of dry air takes place. For introduction of the coolant 27, which is solid at room temperature, for example sodium and/or potassium, the latter is pressed through the opening 25 under protective gas (for example nitrogen, inert gas, or dry air), by means of a press, so that the coolant 27 can be pressed into the bore 24*a* and the cooling channel 23 in wire form. Instead of the pure metal, an alloy of sodium and potassium can also be used, which is already liquid at room temperature. A further method for filling the bore 24*a* is characterized in that after flushing with nitrogen, inert gas, or dry air, the bores 24*a-d* and the cooling channel 23 are evacuated, and the coolant 27 is introduced in a vacuum. In this way, the coolant 27 can move back and forth in the cooling channel 23 and into and out of the bores 24*a-d* more easily, because it is not hindered by protective gas that is present.

It has been shown, in practical manner, that if the proportion of combustion heat that flows off into the piston during engine operation is supposed to be limited, this can be controlled with the amount of coolant that is filled in. It has furthermore been shown that sometimes, filling of 3-5% of the cooling channel volume with the coolant is already sufficient to ensure proper functioning of the piston.

Another possibility for removing the protective gas from the cooling channel 23 and the bores 24*a-d* consists in using nitrogen or dry air (i.e. essentially a mixture of nitrogen and oxygen) as the protective gas and adding a small amount of lithium to the coolant 27, empirically about 1.8 mg to 2.0 mg lithium per cubic centimeter of gas space (i.e. volume of the cooling channel 23 plus volume of the bores 24*a-d*). While sodium and potassium react with oxygen to form oxides, the lithium reacts with nitrogen to form lithium nitride. The protective gas is thereby bound in the coolant 27 almost completely, as a solid.

The invention claimed is:

1. A piston for an internal combustion engine, comprising;

a piston head having a circumferential ring belt and a circumferential cooling channel in a region of the ring belt;

a piston skirt having pin bosses provided with pin bores, said pin bosses being disposed on an underside of the piston head by way of pin boss connections, wherein the pin bosses are connected with one another by way of working surfaces, wherein at least four axial bores, closed toward the outside, are provided within the pin bosses, said axial bores being disposed between one of the working surfaces and one of the pin bores, respectively, wherein the at least four axial bores open into the cooling channel, wherein the cooling channel and the at least four axial bores contain a filling composed of sodium and/or potassium, and wherein exactly one of the axial bores comprises an opening that is closed off by a closure element.

2. The piston according to claim 1, wherein the closure element is pressed into the axial bore or welded to the piston.

3. The piston according to claim 1, wherein the filling has a filling level of up to half the height of the cooling channel.

4. The piston according to claim 1, wherein the filling has a filling amount of 3% to 5% of the volume of the cooling channel.

5. The piston according to claim 1, wherein the filling consists of a potassium/sodium alloy with 22 wt.-% sodium and 78 wt.-% potassium.

6. The piston according to claim 1, wherein the filling contains lithium and/or lithium nitride.

7. The piston according to claim 1, wherein the filling contains sodium oxides and/or potassium oxides.

* * * * *